US005732532A

United States Patent [19]

Fujisaki et al.

[11] Patent Number: 5,732,532

[45] Date of Patent: Mar. 31, 1998

[54] SYSTEM AND METHOD FOR RELIABLY FILLING BAGS WITH SOLIDS, INCLUDING MEANS FOR PREVENTING BLOCKAGE OF THE SOLIDS

[75] Inventors: Yasuo Fujisaki; Hiroshi Sakai, both of Higashi-Osaka, Japan

[73] Assignee: House Foods Corporation, Osaka, Japan

[21] Appl. No.: 707,731

[22] Filed: Sep. 3, 1996

[30] Foreign Application Priority Data

Sep. 4, 1995 [JP] Japan ..... 7-226654

[51] Int. Cl.[6] ..... B65B 9/20; B65B 37/00; B65B 37/02; B65B 39/00

[52] U.S. Cl. ..... 53/451; 53/552; 141/10

[58] Field of Search ..... 53/451, 551, 552, 53/554; 141/10, 114

[56] References Cited

U.S. PATENT DOCUMENTS

| | | | |
|---|---|---|---|
| 3,538,676 | 11/1970 | Runo et al. | 53/552 |
| 3,785,112 | 1/1974 | Leasure et al. | 53/551 X |
| 3,925,963 | 12/1975 | Greenawalt et al. . | |
| 4,043,098 | 8/1977 | Putnam, Jr. et al. . | |
| 4,079,662 | 3/1978 | Puccetti et al. . | |
| 4,144,693 | 3/1979 | Ogata | 53/552 X |
| 4,597,240 | 7/1986 | Scully | 53/552 X |
| 4,640,083 | 2/1987 | Takahashi et al. | 53/551 |
| 4,697,403 | 10/1987 | Simpson et al. | 53/551 |
| 4,909,017 | 3/1990 | McMahon et al. | 53/551 X |
| 4,974,395 | 12/1990 | McMahon . | |
| 5,255,497 | 10/1993 | Zoromski et al. | 53/552 X |
| 5,313,766 | 5/1994 | Rimondi et al. | 53/551 X |
| 5,505,040 | 4/1996 | Janssen et al. | 53/551 X |

FOREIGN PATENT DOCUMENTS 6-99917 4/1994 Japan .

*Primary Examiner*—Horace M. Culver
*Attorney, Agent, or Firm*—Reid & Priest L.L.P.

[57] ABSTRACT

A system and method for forming bags and reliably filling them with solids (such as snack food) prevent blockages of the solids during the filling process, and enable the bag forming and bag filling processes to occur continuously in an overlapping manner, thus improving production efficiency. Longitudinal openings are provided in the lower end of a hollow tubular vertical mandrel. Solids fall by gravity through the interior of the mandrel toward a bag that is formed at the bottom of the mandrel. The longitudinal openings allow solids to protrude radially outward from the mandrel if they form a blockage in the mandrel. The protruding solids that are part of the blockage are dislodged by frictional contact with a tubular film as it is forwarded snugly down the exterior of the mandrel. The film ultimately form the bag into which the solids fall.

13 Claims, 7 Drawing Sheets

SYSTEM AND METHOD FOR RELIABLY FILLING BAGS WITH SOLIDS, INCLUDING MEANS FOR PREVENTING BLOCKAGE OF THE SOLIDS

TECHNICAL FIELD

The present invention relates to a filling with solids system and a filling with solids method using this system, and in particular, it relates to the filling with solids system and the filling with solids method using this system which are capable of preventing a blocking caused by solids.

BACKGROUND OF THE INVENTION

Nowadays, an amount of snack food such as potato chips is sold in a packing sack for the purpose of making handling easy and maintaining stable quality of product. Particularly, a box-type packing sack, whose bottom flat portion allows the entire sack to be stood erect, is used due to the convenience with which it can be exhibited at stores. The manufacturing process of such a configuration of a sack can be mainly divided into a sack forming process and a filling process where a completed sack is filled with snack food. To improve production efficiency, it is desirable that the products be manufactured continously in an assembly line and that the sack forming process and the filling process proceed in an overlapping manner each time a product is manufactured.

In view of the above, a solid filling system is disclosed in, for instance, Japanese Patent Laid-Open Publication HEI6-99917 which utilizes a tubular mandrel for forming a sheet like film into a sack, while at the same time the resultant sacks are continously filled with solids.

This filling with solids system will now be described briefly. A sheet like film is wound around an outer peripheral surface of the tubular mandrel which has a predetermined longitudinal length, and the opposite ends of the film are sealed by a back sealer which extends longitudinally along the outer surface of the tubular mandrel in such a way that the sheet like film is formed into a tubular film. Then the tubular film is sealed laterally by means of a lateral sealer provided below the lower end opening of a tubular mandrel so that the tubular film is formed into a film in the form of a sack. Then, the solids drops freely from the upper end opening of the tubular mandrel through a filling passage defined by a hollow portion of the tubular mandrel into a film formed as a sack and then the filled film formed as a sack is forwarded in the longitudinal direction of the tubular mandrel by a film forwarding means, similar to the back sealer, which extends longitudinally along the outer surface of the tubular mandrel. The filling with solids system is so configured that the respective film formed as sacks can be filled with solids continuously by repeating the above-described processes.

Utilizing the profile and the hollow portion of the tubular mandrel indeed allows a sack forming process and a filling process to proceed in an overlapping manner in an assembly line, thereby causing production efficiency to be ensured.

However, solids can cause the filling passage of the tubular mandrel to be blocked upon the solids being charged therein, thereby causing making it impossible to fill the sack with solids depending on the amount of solids sack being filled with per unit time, the cross sectional area of the tubular mandrel and the characteristics of the solids, in particular, the frictional characteristic of the inner face of the tubular mandrel.

More specifically, a layer of solids may be formed at a certain position of the tubular mandrel in its longitudinal direction at a certain moment, with some solids being supported by the inner surface of the shape retained tubular mandrel, and as a result, the communication through the layer can be blocked so that the solids cannnot pass continuously through the filling passage into the film formed as a sack.

In particular, in the above-described box-type packing sack, since it is necessary to utilize the peripheral edge of the tubular mandrel, which defines a lower end opening therein, as a mold for forming a bottom surface of the sack when such a sack is sealed by the above-described lateral sealer, it is required that the lateral sealer be disposed immediately below the lower end opening of the tubular mandrel. As a result, the tubular mandrel extends from the bottom portion of the film formed as a sack, which bottom portion has been formed by sealing the film to even more increase the possibility of the blocking of the filling passage of the tubular mandrel.

In this situation, if a film formed as a sack is continuously filled with even more solids, such solids may be deposited on the layer of solids blocking the filling passage, and as a result, their own weight can cause these blocking solids to naturally collapse.

However, as described above, since the sack forming process and the filling process have to proceed in accordance with a very complex arrangement of different timings, even though the inability or the sack to be filled can be overcome, the amount of solids in the respective films formed as sacks may vary due to the resultant disorder caused by such a complex arrangement timing, or the solids can become sandwiched between the sides of the pressed tubular film at that portion where they are sealed together to form the sack, both of which events can cause reduction of production efficiency.

In order to prevent the occurrence of such blocking in advance, it may be considered easy to vibrate the tubular mandrel itself when the film formed as a sack is filled with solids. However, providing of a vibration system for vibrating the tubular mandrel is required, so that costs will be increased. Further, the vibration for preventing the occurrence of the blocking can make it difficult for the sack forming process, including the tubular film forwarding process, to proceed. In short, it is extremely difficult to prevent the occurrence of the blocking when the film formed as a sack is filled with solids, while at the same time the sack forming process and the filling process are proceeding in an overlapping manner.

In this connection, the shorter the longitudinal length of the tubular mandrel becomes, the lower the possibility of the occurrence of the blocking becomes. However, as described above, the performing of the back sealing process and the tubular film forwarding process along with the sack forming process and the filling process is normally required, and thus, due to the nature of the whole process, the back sealing means and the tubular film forwarding means have to be arranged to be at a certain position between the upper end opening of the tubular mandrel and the lower end opening thereof. Accordingly, the tubular mandrel must have a minimum longitudinal length in order to accomplish the sack forming process and the filling process in an overlapping manner.

SUMMARY OF THE INVENTION

In view of the above described problems, the object of the present invention is to provide a filling with solids system which is capable of securely overcoming the inability of filling with solids by removing the blocking by the solids, which blocking occurs during the filling process, while at the same time enabling the sack forming process and the filling process to proceed in an overlapping manner.

Another object of the present invention is to provide a filling with solids system and a filling with solids method which are capable of controlling the continuous filling of the respective films formed as a sack with solids so that the amounts they are filled with are kept substantially constant, or preventing solids from being sandwiched between the opposite portions of the pressed tubular films at that portion where they are sealed together.

Still another object of the present invention is to provide a filling with solids system which is capable of removing the blocking solids in a suitable manner depending on the type of solids, the amount of solids the sack formed film is being filled with, etc. without needing to convert the existing filling with solids system.

According to a first aspect of the present invention, when a sheet like film is wound around the outer peripheral surface of a tubular mandrel so that it is formed into a tubular configuration, and then the solids are dropped freely from the upper end opening of the tubular mandrel through the filling passage defined in the interior of the tubular mandrel and then discharged through the lower end opening thereof, the blocking solids may occur in such a way that the solids overlap one another in a three dimensional manner at a certain position of the filling passage and then cover the entire cross sectional area thereof to make it impossible to fill the filling passage with solids. At this moment, since openings in which the solids are protruded which extends longitudinally are provided at the periphreral surface of the tubular mandrel, some solids are retained in such a way that they protrude through the openings to contact the inner face of the tubular film. Then, by forwarding the tubular film, which is wound around the outer peripheral surface of the tubular mandrel, longitudinally from the lower end opening of the tubular mandrel by means of the tubular film forwarding means, the wound tubular film moves longitudinally relative to the tubular mandrel and then the solids, which are retained by contacting the inner face of the tubular film, are dragged in the same direction by the moving tubular film. And then, such solids change at least their postures so that the change of the positional relationship among the adjacent solids causes the blocking solids to be collapsed, and as a result, the sack forming process and the filling process can proceed in an overlapping manner, while at the same time the inability of the filling with solids can be securely overcome.

According to second and third aspects of the present invention, the tubular film, which is forwarded from the lower end opening of the tubular mandrel, is formed into a sack configuration by means of the sack forming means, the open end of the sack facing in the direction of the upper end opening, and then the film formed as a sack is filled with solids which enter the filling passage via the upper end opening, so that the solids are deposited at the bottom portion of the sack film formed at a certain forward position from the lower end opening. At this moment, the solids are deposited up to a height higher than the level of the lower end opening, while at the same time they cover the whole cross sectional area of the tubular mandrel, and as a result, the blocking may occur at a certain position of the tubular mandrel depending on the amount of solids a sack is being filled with per unit time, the cross sectional area of the tubular mandrel and the characteristics, the size and the shape of the solids. When the blocking occurs, the solids near the inner face of the tubular mandrel protrude from openings, which openings are so formed at an outer surface of the tubular mandrel as to be cut away over a certain length in a backward direction from the end edge defining the lower end opening. As a result, the solids contact the inner face of the tubular film wound around the outer peripheral surface of the tubular mandrel to be retained thereby. Then, after the tubular film is forwarded longitudinally from the lower end opening by the tubular film forwarding means, similar to the case of the first aspect of the invention, the blocking solids are collapsed, so that the inability of filling with solids can be securely overcome.

in addition, in a case where the above process is repeated in an assembly line manner, the blocking solids is collapsed during the process of forwarding one film formed as a sack, so that the one film formed as a sack is always unfailingly filled with a certain amount of solids by the time the next tubular film is formed into a sack. As a result, the amounts of solids the respective films formed as sacks are filled with can be kept substantially constant while at the same time, the solids can be prevented from being sandwiched between the opposite portions of the pressed tubular film, thus enabling the respective films formed as sacks to be filled with solids continuously, whereby production efficiency can be enusured.

According to a fourth aspect of the present invention, by providing a tube for removing the blocking solids which fits into the lower end opening of the tubular mandrel and extends therefrom, the blocking caused by the solids can be securely prevented in such a way that the size, the shape, etc. of a notch in which solids are protruded of the tube for removing the blocking, which notch extends backwardly from the peripheral edge of the tube's tip opening, may be appropriately selected depending on the type of solids, the amount of solids which a sack is being filled with, etc. without the need to convert an existing filling with solids system.

BRIEF DESCRIPTION OF THE DRAWINGS

The above and other objects and advantages of the present inventions will become apparent from the following description when read in conjuction with the accompanying drawings wherein.

DETAILED DESCRIPTION OF THE PREFERRED EMBODIMENTS

The preferred embodiments will be hereinafter described with reference to the accompanying drawings.

Figure 1:
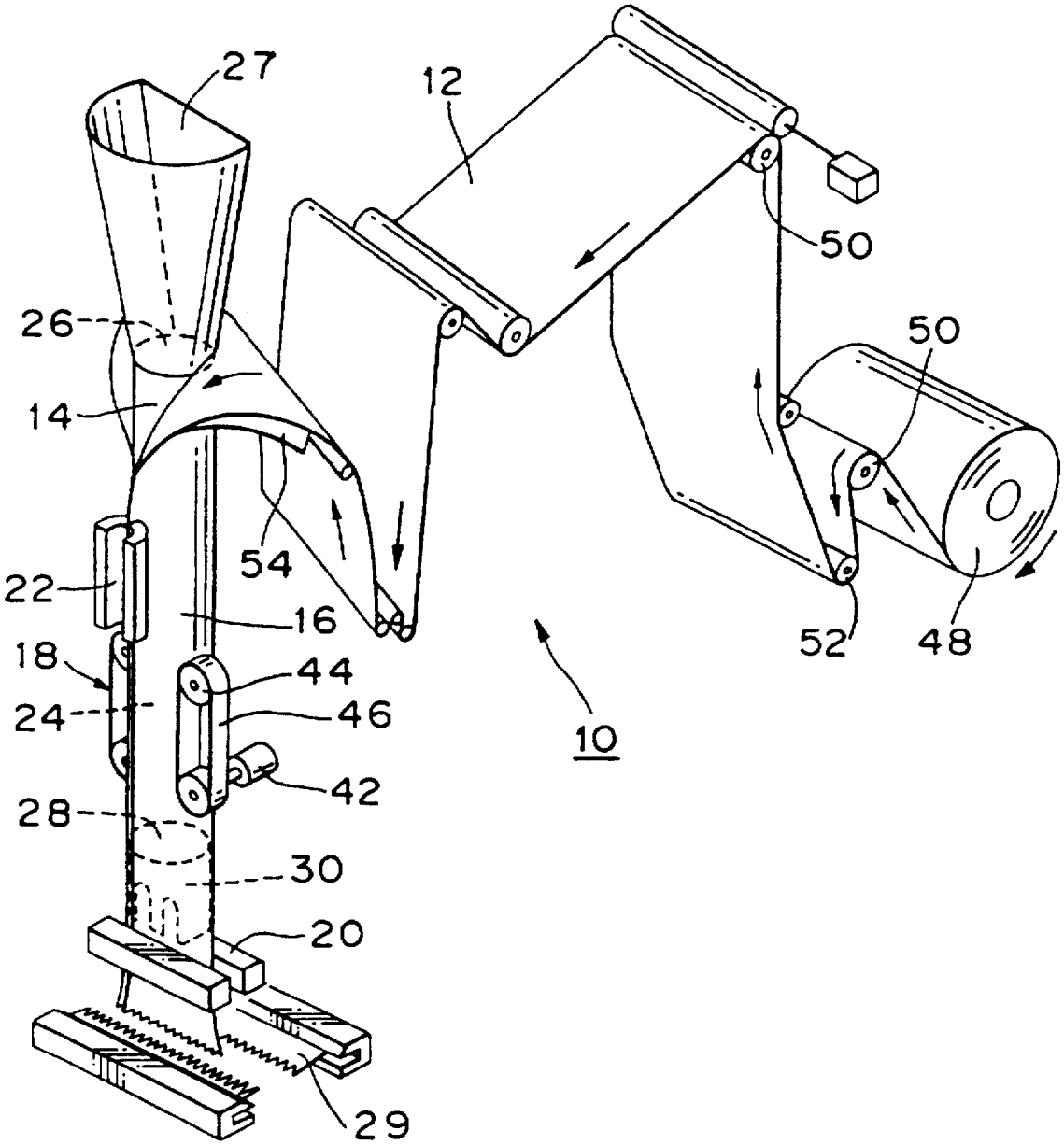
FIG. 1 is a schematic perspective view of a filling with solids system of the preferred embodiment of the present invention.

In FIG. 1, a filling with solids system 10 schematically comprises a tubular mandrel 14 for forming a sheet like film 12 made of polyethylene, etc. into a tubular form, a tubular film forwarding means 18 for forwarding the resultant tubular film 16 in the longitudinal direction, a sack forming means 20 for forming the tubular film 16 into a sack form, and a back sealer 22 for sealing the back portion of the sheet like film 12.

The tubular mandrel 14, which is of a conventional type, consists of a longitudinally extending cylinder which has a uniform circular cross section over its entire length. A filling passage 24 for solids is defined in the interior of the tubular mandrel 14. A metering hopper 27 is provided at an upper end opening 26 of the mandrel 14 so that a quantity of metered solids drops freely from the upper end opening 26 through the filling passage 24 and then is discharged through a lower end opening 28 of the mandrel 14 to be introduced into the tubular film 16. The metering hopper 27, which is of a conventional type, is so configured that solids are fed from the upper end opening 26 into the tubular mandrel 14 with some of the solids covering the entire cross sectional area of the tubular mandrel 14. A tube 30 for removing blocking solids fits into the lower end opening 28, as described below.

Figure 2:
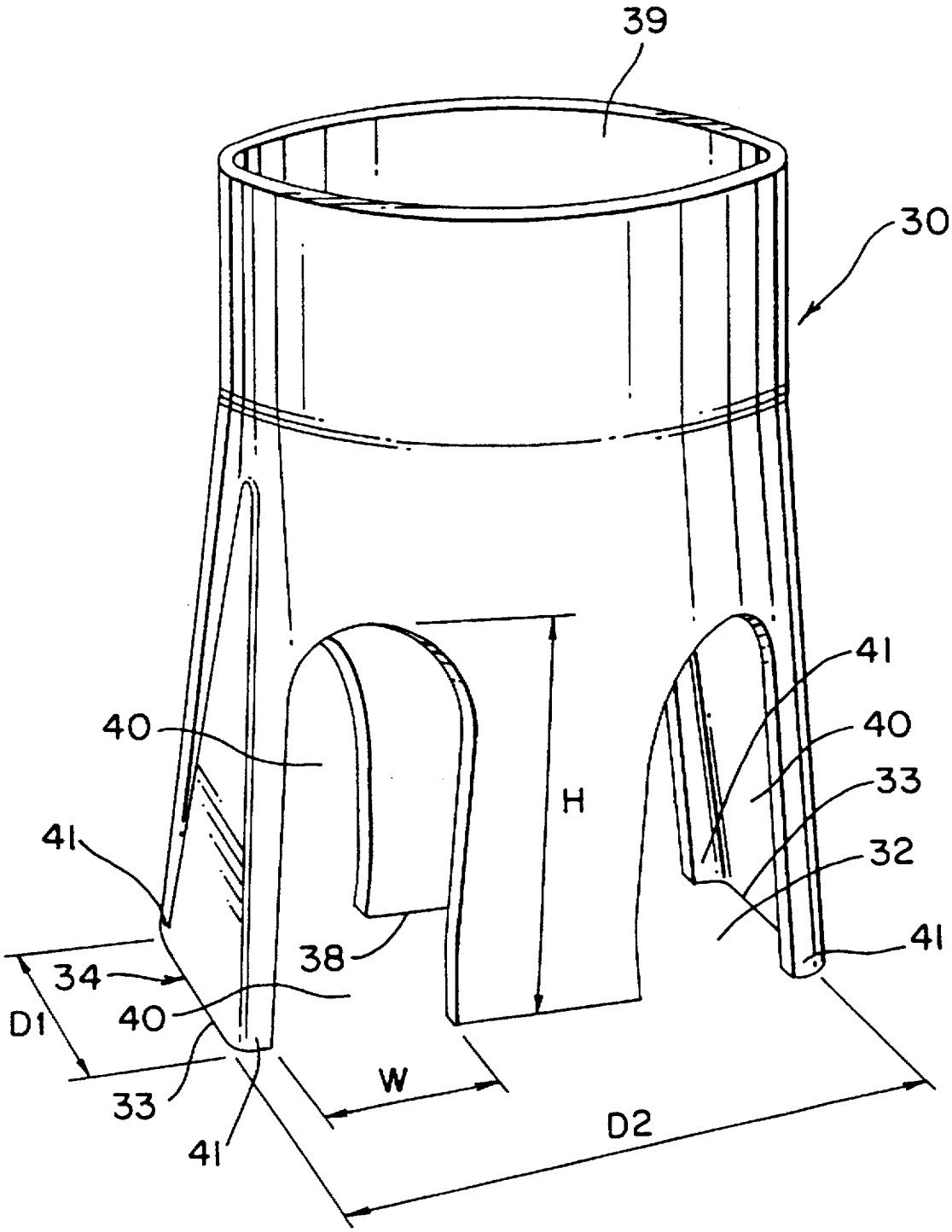
FIG. 2 is a perspective view of a tube for removing the blocking solids.

Now we will describe the tube 30 for removing blocking solids with reference to FIGS. 1 and 2. An upper end of an opening 39 of the tube 30 for removing blocking solids fits into the lower end opening 28 of the tubular mandrel 14. The tube 30 for removing blocking solids extends a predetermined length in conformity with the profile of the tubular mandrel 14. Accordingly, the interior of the tube 30 is adapted to communicate with the filling passage 24. The outer peripheral length of the tube 30 for removing blocking solids is set to be shorter than that of the tubular mandrel 14 so that the tubular film 16 is prevented from being stopped by the outer surface of the tube 30 for removing blocking solids when the tubular film 16 is forwarded by a tubular film forwarding means 18, which will be described below. In addition, the tube 30 includes four substantially reversed U-shaped notches 40 (Only two of them are shown in FIG. 2) in which solids protrude, each of which extends backwardly and longitudinally from a tip peripheral edge 34 of a tip opening 32. The size of each notch, that is, the width W and the height H, may be appropriately selected in accordance with the amount of solids a sack is to be filled with, the characteristics of the solids, the cross sectional area of the tubular mandrel 14, etc. Each of the notches 40 enables the solids inside the tube 30 to be directed toward the inner face of the tubular film 16 wound around the outer peripheral surface of the tubular mandrel 14. In view of the fact that the blocking caused by the solids tends to occur at a position lower than the level to which a sack is filled with solids, the top ends of the respective notches 40 are set higher than h(See FIG. 5), which is a height to which the solids are filled in a sack from a bottom portion 36 of a sack film formed by the sack forming means 20, which will be described below.

Furthermore, the tip peripheral edge 34 of the tube 30 forms a mold for forming a bottom surface 36 of a film formed as a sack into a plane form. The mold, which has a D1×D2 rectangular shape, consists of one pair of opposite end edges 38 and another pair of opposite end edges 33, with four corner portions 41 being formed at the intersections of the respective end edges 33 and the respective end edges 38. The end edges 33 and the end edges 38 lie in the same plane. The pair of the opposite end edges 38 are disposed to be substantially parallel with a bottom seal portion 37(See FIG. 5) formed by the pair of lateral sealers 20 which will be described later. The notches 40 are formed at the pair of the opposite end edges 38 in order to leave the four corner portions 41 for securing the molding function.

With reference again to FIG. 1, the tubular film forwarding means 18 includes a driving motor 42 of a conventinal type, a pair of rollers 44, one of which consists of a driving roller connected to the driving motor 42, an endless belt 46 which is spanned between the pair of rollers 44 and is disposed so as to contact the outer surface of the tubular film 16 in the longitudinal direction thereof. The tubular film forwarding means 18 is adapted to move forwardly and longitudinally in an intermittent manner the tubular film 16 wound around the outer surface of the tubular mandrel 14 from the lower end opening 28 of the tubular mandrel 14.

The sack forming means 20 is adapted to form the tubular film 16 forwarded from the lower end opening 28 into a sack form the open end of which faces in the direction of the upper end opening 26. More specifically, the sack forming means 20 consists of a pair of lateral sealers 20 facing each other which the tubular film 16 are interposed between and are disposed to be longitudinally adjacent to the tip opening 32. The pair of the lateral sealers 20 are adapted to move toward and away from each other in the direction substantially perpendicular to the longitudinal direction to sandwich the tubular film 16 at a position below the filling passage 24, so as to press two opposite portions of the tubular film 16 against each other to seal an opening portion of the tubular film 16. The pair of the lateral sealers 20 enables the bottom seal portion 37 of the one film formed as a sack and the upper seal portion 66 of the other film formed as a sack, which is situated to be longitudinally adjacent to each other (See FIG. 5) to be created simultaneously. Therefore, the sack film bottom portion 36(See FIG. 5) is formed at a position adjacent to the tip opening 32 of the tube 30.

In this connection, a pushing and folding means (not shown) for pushing and folding back each side of the sealed portions of the tubular film 16 toward each of the corresponding end edges 33 of the mold is provided at a position immediately above the lateral sealers 20, in order to set a linear length of the bottom seal portion 37 shorter than the length D2 of the mold when two opposite portions of the tubular film 16 are pressed against each other and sealed. A conventional cutter 29 for cutting the upper end of the sealed film formed as a sack is also provided at a position immediately below the lateral sealer 20.

In addition, the timing of the action of feeding solids by the metering hopper 27, the action of forwarding the tubular film 16 by the tubular film forwarding means 18, the action of sealing the two opposite portions of the tubular film 16 by the lateral sealers 20 and the action of cutting the film formed as a sack by the cutter 29, etc. are controlled by a commonly known computer in which a control programme is stored.

The back seal means 22 is arranged longitudinally at a predetermined position on the tubular mandrel 14 and is adapted to feed heat toward the interior of the tubular mandrel 14 in order to melt and seal the overlapped opposite end portions of the sheet like film 12 wound around the tubular mandrel 14. Therefore, an inner tube which is disposed substantially coaxial with the tubular mandrel 14 and extends longitudinally from the upper end opening 26 to the top end of the notches in which solids protrude may be provided to provide a shield against the heat transferred from the back seal means 22 in order to protect to some extent solids passing through the inner tube.

In this connection, reference number 48 designates a bobbin of the sheet like film 12 which delivers the sheet like film 12 through a guide roll 50 and a dancer roller 52 to a former 54 and then forms the sheet like film 12 into the tubular film 16 at a position between the former 54 and the outer surface of the tubular cylinder 14.

The operation of the filling with solids system 10 including the above described constructions will now be described with reference to FIGS. 3 and 4.

Firstly, the sheet like film 12 is wound around the outer surface of the tubular mandrel 14 in order to form the sheet like film 12 delivered to the former 54 into the tubular film 16.

In this connection, the sheet like film 12 so wound is formed into the tubular film 16 by the back sealer 22 upon the film 12 being forwarded, as will be described later.

Then, in order to form the tubular film 16 into a sack configuration, the tubular film 16 is sealed lateraly by the pair of lateral sealers 20, while the outer surface of the tubular film 16 is pressed inwardly toward the respective end edges 33 by the pushing and folding means. This enables the bottom seal portion 37 to be formed with a tubular film C, while at the same time enabling an upper seal portion to be formed in a tubular film D, which is situated below the film C.

At this time, a substantially flat bottom surface 62(See FIG. 5) whose size is D1×D2 is formed by the mold formed around the peripheral edge 34 of the tube 30 for removing the blocking solids. In other words, when the tubular film 16 is pressed at the position immediately below the mold by means of the pair of lateral sealers 20 and the pushing and folding means, the bottom surface 62 is formed by creases defining its peripheral edge being formed by means of the peripheral edge 34.

Then, the film formed as a sack C is filled with a certain amount of solids which are fed from the metering hopper 27, through the upper end opening 26 of the tubular mandrel 14, and to the filling passage 24.

As a result, solids are deposited on the bottom portion 36 of the film C formed as a sack longitudinally adjacent to the tip opening 32. At this time, the solids are deposited up to a height higher than the level of the lower end opening 28 of the mandrel 14, while at the same time some of the solids cover the cross sectional area of the tubular mandrel 14. Under these circumstances, the blocking by the solids can occur at a certain position depending on the amount of solids which a sack is filled with per unit time, the cross sectional area of the tubular mandrel 14 and the characteristics, the size and the shape of one solid piece, etc. When the blocking solids occurs, as shown in FIG. 4, solids near the inner face of the tubular mandrel 14 protrude through the notches 40 to be supported by the inner face of the tubular film 16 wound around the outer peripheral surface of the tubular mandrel 14.

Then, the tubular film 16 is forwarded in the longitudinal direction by the tubular film forwarding means 18. The longitudinal length of the film formed as a sack can be controlled by adjusting the amount of the tubular film 16 forwarded at one time. At this time, the longitudinal movement of the tubular film 16 causes respective postures of solids which contact the inner face of the tubular film 16 via notches 40 to be changed, thereby causing the solids to be agitated one after another to collapse the blocking solids, and thus, the inability of filling with the solids can be steadily overcome.

Figure 3:
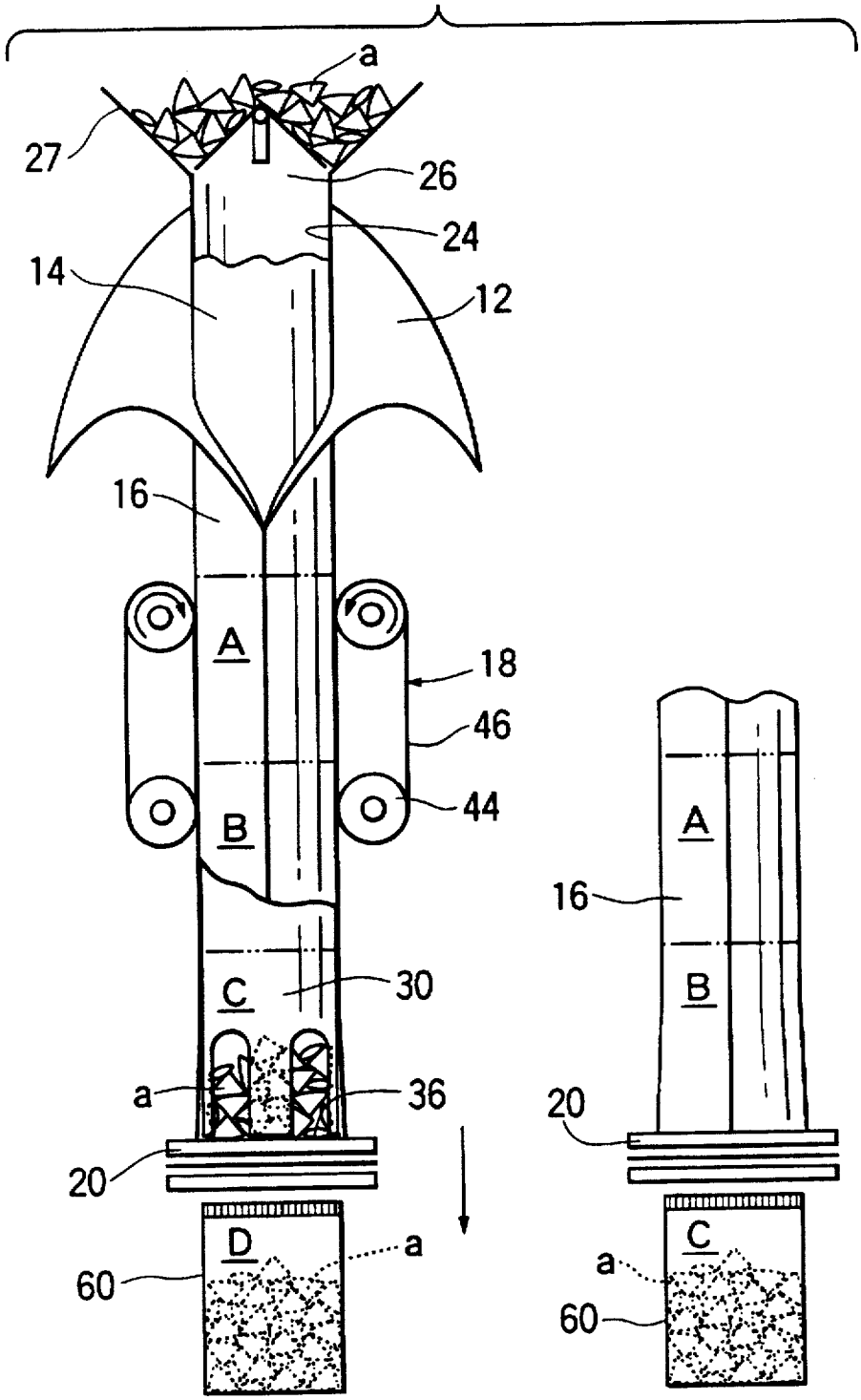
FIG. 3 is a schematic view of a filling with solids method of the preferred embodiment of the present invention.
Figure 4:
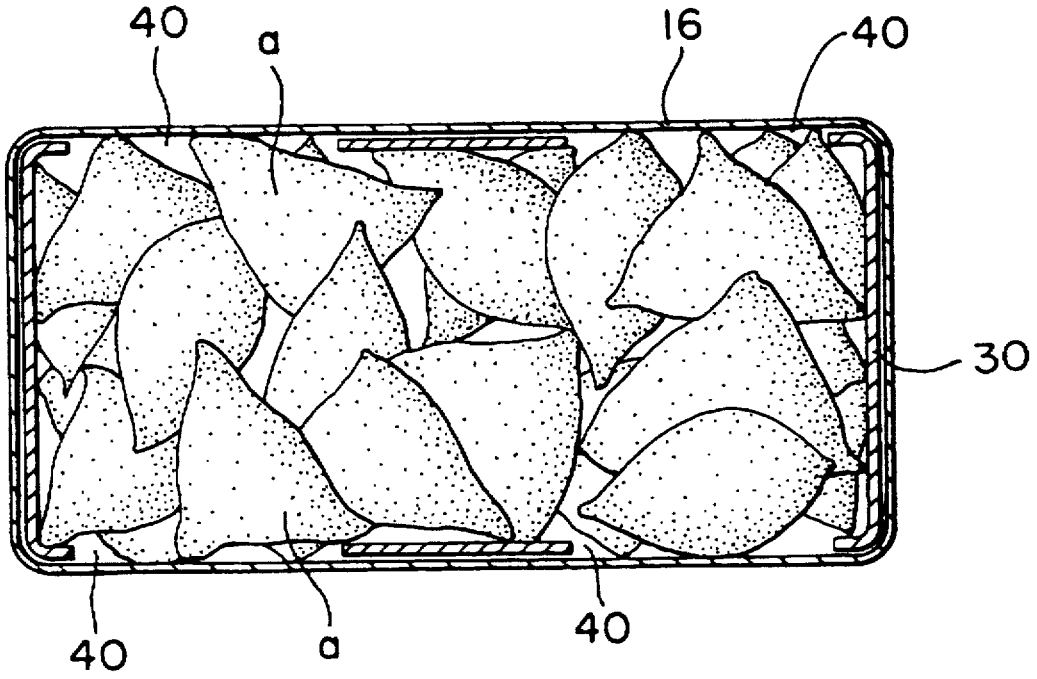
FIG. 4 is a cross sectional view showing the blocking solids.

During the one performace of the forwarding process, that is, by the time the next sack B is formed as shown in FIG. 3, the blocking solids are collapsed so that the film formed as a sack C becomes filled with solids which remains in the filling passage 24, and thus the amount of solids which each film formed as a sack is filled with can be kept substantially constant.

Then, the upper end of the film formed as a sack C is cut away by the cutter 29 and then the completed sack 60, which is self-standing, is transported by a conventional conveyor, etc. (not shown).

Applying the above process cycles repeatedly to the tubular films C, B and A in this order, each film formed as a sack can be filled with a constant amount of the solids continuously.

Figure 5:
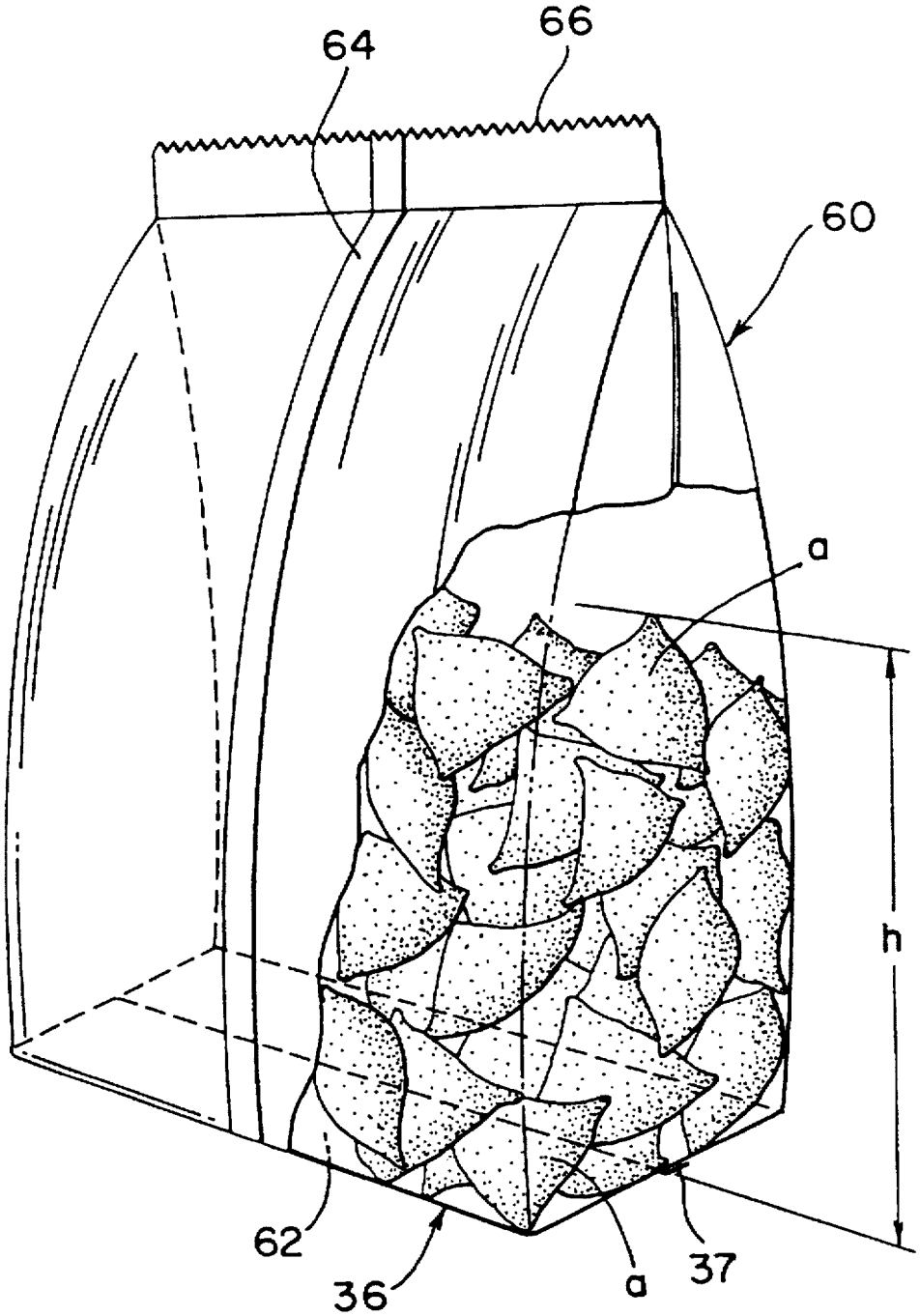
FIG. 5 is a schematic perspective view of a box type sack in a self-standing configuration completed by the filling with solids system of the preferred embodiment of the present invention.

FIG. 5 shows the self-standing type sack 60 filled with solids formed by the filling with solids system 10. As shown in FIG. 5, the sack 60 contains solids up to the level of h and includes the substantially flat bottom surface 62 of the bottom portion 36 formed by the mold. A cutting portion 66 is formed at the upper portion of the sack 60, the bottom seat portion 37 is formed at the bottom surface 62 by the pair of lateral sealers 20, and a back seal portion 64 is formed at the side surface of the sack 60 by the back sealer 22.

The present inventor carried out the following test using the above described solid filling system in order to ascertain that the present invention had the effect of removing the blocking solids. The test conditions were as follows.

(a)food solids
- type; snack
- materials;potato starch
- shape; hollow triangle
- size; maximum width 48 mm, maximum height 30 mm
- mean specific gravity;0. 0597

(b)amount sack filled with total amount each sack filled with; 61 g
- height h to which solids in a sack are filled (See FIG. 5); 90 mm (c)tubular mandrel
- shape; a hollow cylinder
- size; inner diameter 120 mm×length about 1500 mm (d)mold
- size (D1×D2); 69 mm×140 mm (e)opening for solids
- shape W×H (See FIG. 2); 34.5 mm×95 mm
- the number; 4

Figure 6:
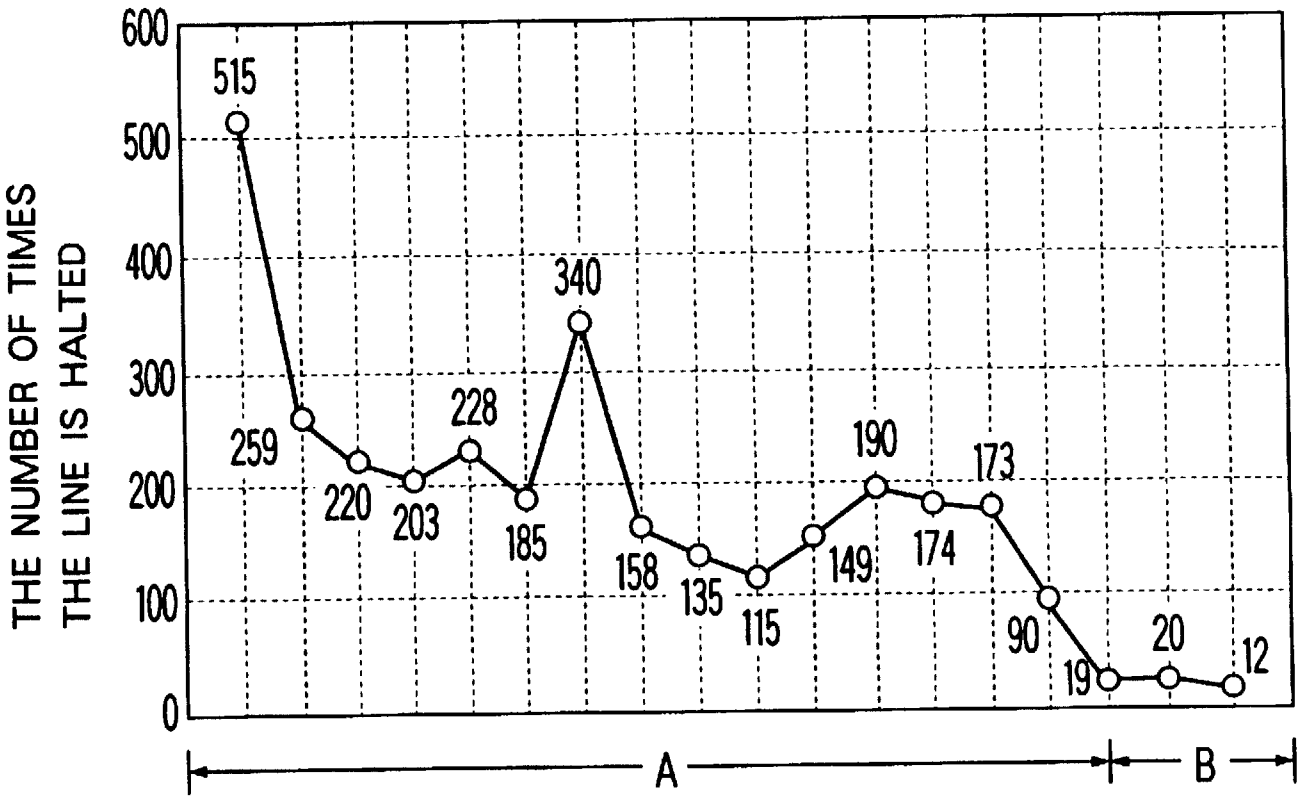
FIG. 6 is a graph showing daily changes in the number of times the line is halted in a case where the filling with solids system of the preferred embodiment of the present invention is used.

(f)sack(film)
- material of the inner face; heat seal polypropylene (g)forward condition
- forwarding speed; approximately 10 m/min FIG. 6 is a graph showing the daily changes in the number of times the line is halted under the above conditions. In FIG. 6, letters A and B indicate the case where the tube for removing the blocking solids is not used, and the case where the tube for removing the blocking solids is used, respectively. With reference to FIG. 6, when the number of line halts in case A is compared with that in case B, it is seen that the use of the tube 30 for removing the blocking solids causes the number of line halts to be reduced to at least less than twenty. In this connection, the line halts in this case is caused by the fact that the solid is sandwiched between the two opposite portions of the pressed tubular film at the seal portion 36, and therefore the number of the line halts is considered to be substantially the same as the number of times the blocking by the solids occurs.

Figure 7:
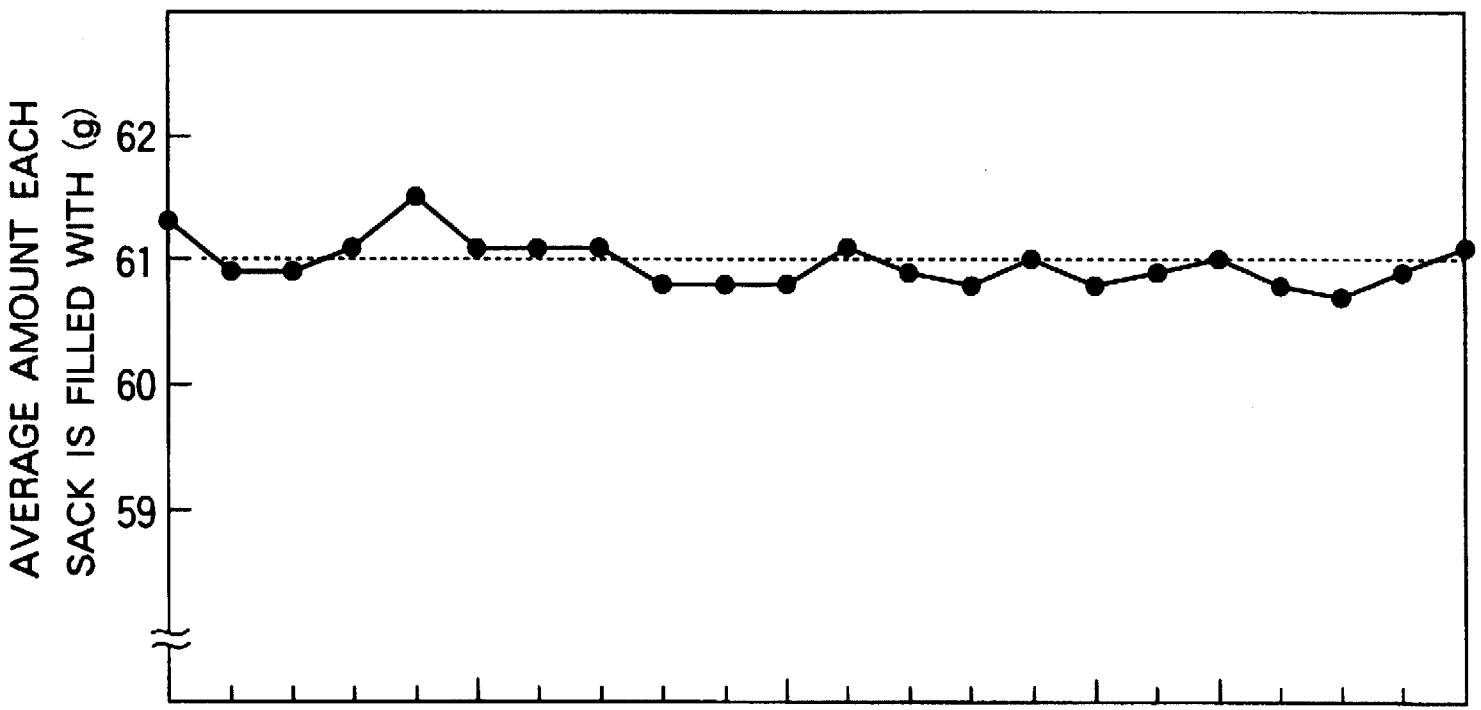
FIG. 7 is a graph showing hourly changes in the filling with solids amounts in a case where the filling with solids system of the preferred embodiment of the present invention is used.

FIG. 7 is a graph showing hourly changes in the amount of solids each sack is filled with. Referring to FIG. 7, it is seen that the average amount of solids each sack is filled with is kept substantially constant, that is, 61*g*.

While the preferred embodiment of the invention has been illustrated and described in detail, it will be apparent that various changes may be made in the disclosed embodiment without departing from the scope of the invention. For instance, the solids are not limited to snacks, in other words, the present invention is also applicable to and effective for relatively small particles such as coffee beans so long as there is a possibility of a block being caused by the solids. In addition, the present invention is applicable not only to a sliced configuration such as potato chips but also a stick one which does not have a three dimensional shape. Moreover, the notches which the solids are protruded through may be disposed not only at the pair of opposite end edges 38 of the tube 30 substantially parallel to the seal portion 37, but also at a pair of opposite end edges which are perpendicular to the bottom seal portion 37. In other words, the notches may be arranged around the entire peripheral edge of the tube 30 for removing the blocking solids, so long as the edge serves as a mold with four corners, said arrangement depending on the amount of solids which a sack is filled with, a characteristics of the solids, the cross sectional area of the tubular mandrel 14, etc.

As can been seen clearly from the above description, according to the first aspect of the present invention, the blocking by the solids, which occurs when the tubular mandrel is filled with solids, can be securely removed by merely moving longitudinally the tubular film wound around the outer surface of the tubular mandrel, and as a result there is no need to provide a new solution means, even if the blocking should occur.

According to the second and third aspects of the present invention, when the respective films formed as sacks are filled with solids successively in an assembly line manner, similar to the case of the first aspect of the invention, the blocking solids can be removed even if the blocking occurs at the bottom portion of the film formed as a sack. As a result, a constant quantity of solids can be fed into the respective films formed as sacks and the solids can be prevented from being sandwiched between the two opposite portions of the pressed tubular film when the tubular film is formed into a sack configuration, thus ensuring production efficiency.

In particular, even if the mold for forming the bottom portion of the film formed as a sack is formed around the peripheral edges defining the lower end opening of the tubular mandrel and the bottom portion of the film formed as a sack is disposed to be longitudinally adjacent to the lower end opening in order to form a box type sack which is self-standing, the above described effect can be obtained without fail.

Finally, according to the fourth aspect of the present invention, the blocking solids can be securely removed simply by mounting the tube for removing the blocking solids, which tube can be selected according to the type of solids, the amount of solids a sack is filled with, etc., on the present tubular mandrel without the need to convert an existing filling with solids system even if the blocking by the solids should occur.

What is claimed is:

1. A system for filling bags with solids, comprising:

a) forwarding means for forwarding, in a longitudinal direction about an outer surface of a mandrel, a tubular film; and b) the mandrel, the mandrel having:

1) an upper opening into which the solids drop freely;

2) an interior passage through which the solids fall and in which blockages of the solids may form;

3) a lower opening out of which the solids may drop; and 4) slot means, extending upward from the lower opening of the mandrel, for allowing dislodging of the blockages of the solids that may occur in the interior passage, by allowing an interior surface of the tubular film being forwarded down the outer surface of the mandrel to frictionally engage solids in the blockage that protrude radially outwardly through the slot means sufficiently to change the position of the solids so as to dislodge the blockage and allow the solids to fall into the bag.

2. The system of claim 1, wherein the slot means includes:

plural slots that extend upward from the lower opening longitudinally along the mandrel.

3. The system of claim 2, wherein:

the plural slots are offset from each other peripherally around the mandrel.

4. The system of claim 1, wherein the slot means includes:

plural openings that cross a certain longitudinal position of the mandrel.

5. The system of claim 1, further comprising:

bag forming means for forming the tubular film into a bag having (1) an upwardly facing open end and (2) a bottom portion that is at a certain position below the lower opening less than a height to which the solids are filled in the bag.

6. The system of claim 5, wherein:

the bag forming means includes a pair of lateral sealers disposed opposite each other adjacent the lower opening, for pressing the tubular film perpendicular to the longitudinal direction of the mandrel to seal an opening of the tubular film; and the lower opening has a peripheral edge that forms a surface mold for forming a bottom of the bag into a plane.

7. The system of claim 6, wherein the surface mold is rectangular and includes:

a first pair of opposite edges, disposed substantially parallel to a seal formed by the pair of lateral sealers, in which first pair of opposite edges the slot means are formed; and a second pair of opposite edges intersecting the first pair of opposite edges to form corresponding corners of the surface mold.

8. The system of claim 5, wherein:

an upper end of the slot means through which the solids protrude is higher than a height defined by solids when the bag is filled.

9. A method performed using an apparatus for filling bags with solids, the apparatus having: (a) forwarding means for forwarding, in a longitudinal direction about an outer surface of a mandrel, a tubular film; and (b) the mandrel, the mandrel having (b1) an upper opening into which the solids drop freely; (b2) an interior passage through which the solids fall and in which blockages of the solids may form; (b3) a lower opening out of which the solids may drop; and (b4) slot means, extending upward from the lower opening of the mandrel, for allowing dislodging of the blockages of the solids that may occur in the interior passage, by allowing an interior surface of the tubular film being forwarded down the outer surface of the mandrel to frictionally engage solids in the blockage that protrude radially outwardly through the slot means sufficiently to change the position of the solids so as to dislodge the blockage and allow the solids to fall into the bag; the method comprising:

forwarding the tubular film longitudinally from the lower opening of the mandrel;

forming a bag from the tubular film forwarded from the lower opening of the mandrel; and filling the bag with solids passed through the top opening and interior passage of the mandrel, while dislodging any blockages of the solids using the slot means during the film forwarding step.

10. A system for filling bags with solids, comprising:

a) forwarding means for forwarding, in a longitudinal direction about an outer surface of a mandrel, a tubular film;

b) the mandrel, the mandrel having:

1) an upper opening into which the solids drop freely;

2) an interior passage through which the solids fall; and 3) a lower opening out of which the solids may drop;

c) a tube that fits into the lower opening of the mandrel, the tube including:

1) a bottom opening; and 2) slot means, extending upward longitudinally from the bottom opening, for allowing dislodging of blockages of the solids that may occur, by allowing an interior surface of the tubular film being forwarded down the outer surface of the mandrel to frictionally engage solids in the blockage that protrude radially outwardly through the slot means sufficiently to change the position of the solids so as to dislodge the blockage and allow the solids to fall into the bag; and d) bag forming means for forming tubular film that was forwarded from the mandrel's lower opening into a bag having an upwardly facing open end and a bottom portion formed a certain position below the bottom opening of the tube, the distance between the certain position and the tube's bottom opening being less than a height to which the solids are filled in the bag.

11. The system of claim 10, wherein:

the bag forming means includes a pair of lateral sealers disposed opposite each other adjacent the bottom opening, for pressing the tubular film perpendicular to the longitudinal direction of the mandrel to seal an opening of the tubular film; and the bottom end has a peripheral edge that forms a surface mold for forming a bottom of the bag into a plane.

12. The system of claim 11, wherein the surface mold is rectangular and includes:

a first pair of opposite edges, disposed substantially parallel to a seal formed by the pair of lateral sealers, in which first pair of opposite edges the slot means are formed; and a second pair of opposite edges intersecting the first pair of opposite edges to form corresponding corners of the surface mold.

13. The system of claim 10, wherein:

an upper end of the slot means through which the solids protrude is higher than a height defined by solids when the bag is filled.

* * * * *